US005810186A

United States Patent [19]

Lam

[11] Patent Number: 5,810,186

[45] Date of Patent: Sep. 22, 1998

[54] GOODS TRANSPORTING PLATFORM

[76] Inventor: David Choon Sen Lam, 11 Wentworth Close, Finchley, London N3, Great Britain

[21] Appl. No.: 752,829

[22] Filed: Nov. 20, 1996

Related U.S. Application Data

[63] Continuation of Ser. No. 512,511, Aug. 8, 1995, abandoned, which is a continuation of Ser. No. 194,540, filed as PCT/GB92/01494, Aug. 12, 1992 published as WO93/03981, Mar. 4, 1993, abandoned.

[30] Foreign Application Priority Data

Aug. 12, 1991 [GB] United Kingdom ..... 9117420

[51] Int. Cl.[6] ..... B65D 19/12

[52] U.S. Cl. ..... 220/1.5; 220/6; 414/498; 108/55.1; 108/56.1

[58] Field of Search ..... 414/498, 265, 414/331, 500, 390, 392, 395; 206/386, 600; 248/346.3; 220/1.5, 6; 108/55.1, 56.1, 53.1; 280/33.998, 639, 79.11, 79.3

[56] References Cited

U.S. PATENT DOCUMENTS

| | | | |
|---|---|---|---|
| 3,402,845 | 9/1968 | Eriksson | 220/1.5 |
| 3,456,826 | 7/1969 | Pavlik | 414/498 |
| 3,620,388 | 11/1971 | Mansson | 108/55.1 X |
| 3,735,713 | 5/1973 | Glassmeyer | 108/53 |
| 3,807,581 | 4/1974 | Nichols . | |
| 3,938,678 | 2/1976 | Kern . | |
| 4,099,640 | 7/1978 | Nessfield et al. | 220/6 |
| 4,108,455 | 8/1978 | James . | |
| 4,319,732 | 3/1982 | Godfrey | 206/600 X |
| 4,638,744 | 1/1987 | Clive-Smith | 108/55.1 X |
| 4,834,000 | 5/1989 | Darnell et al. . | |

FOREIGN PATENT DOCUMENTS

| | | |
|---|---|---|
| 0064852 | 11/1982 | European Pat. Off. . |
| 8403761 | 7/1986 | Netherlands . |
| 827210 | 2/1960 | United Kingdom . |
| 1357233 | 6/1974 | United Kingdom . |
| 2205809 | 12/1988 | United Kingdom . |

OTHER PUBLICATIONS

Brochure: American President Lines; Oakland, CA; May 1989; "Equipment Specifications", 6 pages.

*Primary Examiner*—Stephen Gordon
*Attorney, Agent, or Firm*—Caesar, Rivise, Bernstein, Cohen & Pokotilow, Ltd.

[57] ABSTRACT

A platform dimensioned for the transport of cargo within a shipping container. The platform includes column members and a lifting portion present on the column members. The members are movable between a first condition in which the columns are upright when a load of cargo is present on the platform and a second condition in which the column members are horizontal so that one platform may be stacked upon another. The platform is adapted to be received as a clearance fit inside the shipping container and is provided with a component by which the platform may be moved in or out of the container.

1 Claim, 6 Drawing Sheets

FIG. 10
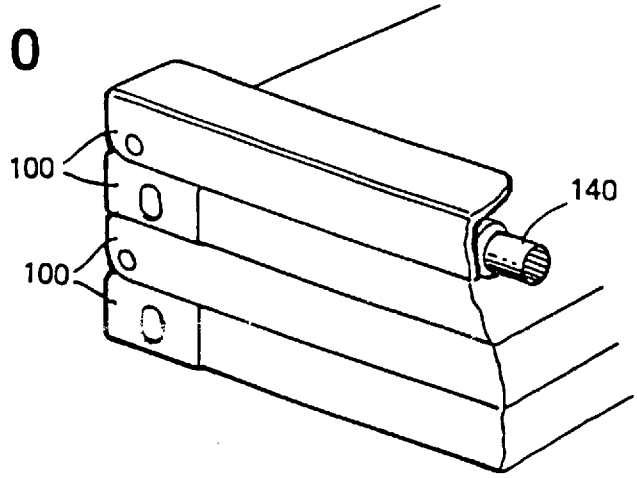
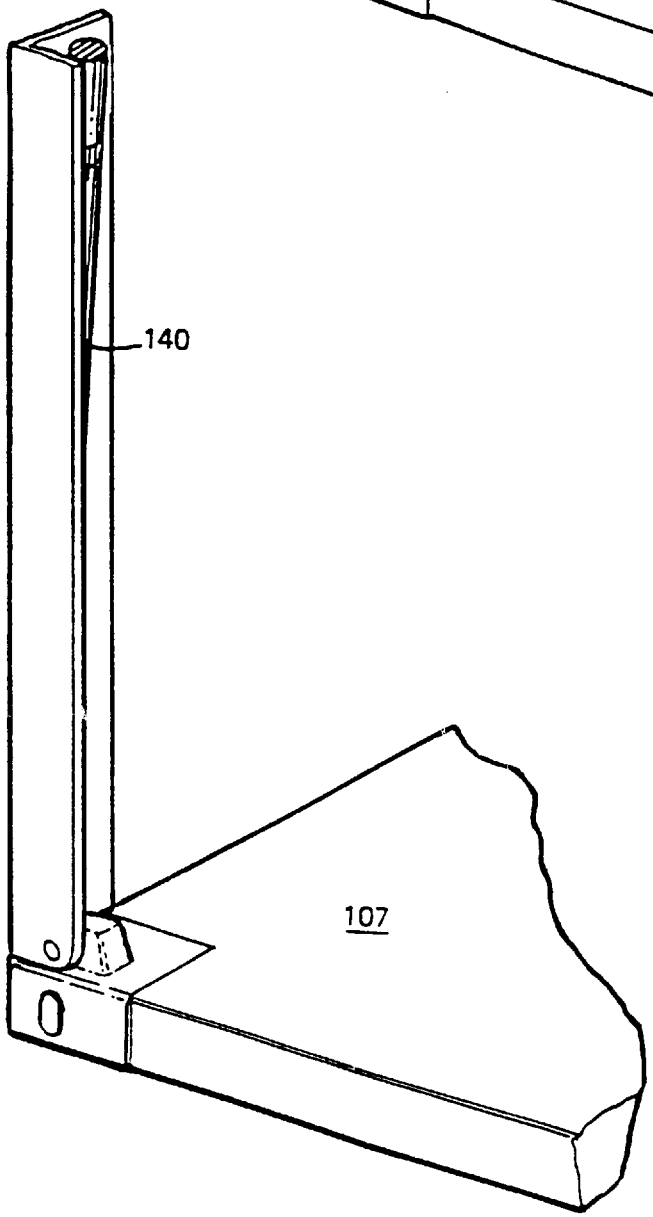
FIG. 11

GOODS TRANSPORTING PLATFORM

This application is a continuation of application Ser. No. 08/512,511, filed Aug. 8, 1995 and now abandoned which is a continuation of application Ser. No. 08/194,540, filed Feb. 10, 1994 and now abandoned which is a national stage application correspondent to PCT/GB92101494 filed Aug. 12, 1992, published as WO93/03981, Mar. 4, 1993.

This invention relates to the transport of goods.

A modern method of transporting goods involves the use of containers (hereinafter referred to as "shipping containers") of standard dimensions and having standard fittings enabling them to be locked onto specially adapted road trailers, railway wagons and ships. One problem with such transport is the expensive need to transport the empty large container to the site where they are to be filled. The problem is exacerbated in locations where it is difficult to transport the containers to the site where they are to be filled. Filling the containers conventionally at a port attracts a charge which would be better avoided or reduced. The operators work so quickly there is often damage to the cargo. Another problem is that it often takes a long time to fill or empty the shipping containers which takes the containers out of use for periods longer than strictly necessary for the mere transport of the goods. A charge is rendered for lifting a container off a ship and for lifting it on the ship, which one more lift than strictly necessary merely to get the cargo on the ship. If space is created on the ship it becomes possible to discharge in one lift a 30/40 platform instead of lifting up and down 30 or 40 times.

It must be appreciated that certain items of cargo are often produced at a site which is inaccessible, or at least inconvenient to reach. Rubber for example is produced at plantations and must be transported from a country usually having poor quality roads—certainly in the region of the plantation—to a port from which it is shipped to an industrial country for processing. The condition of the local roads may limit the weight which can be transported. In an industrial country, e.g. the USA, there is a legal limit to the weight of a truck and its contents which can be moved on the roads, which limit would usually be exceeded if the truck was to carry a shipping container fully laden with a cargo of a material as dense as rubber.

It is known to load cargo on to a platform which may then be moved. For example the platform may have lifting hooks in the corners so that the platform may be lifted using chains by a crane. The platform may also have tunnels or recesses to receive the forks of a fork lift.

The invention is based on a first realization that if the goods are loaded on a platform having means by which the platform may be moved in or out of a container some, if not all, of these problems will be solved. The invention is based on the second realization that if the platform is provided with lifting means which may be stowed, a number of the platforms may be transported in a single container, so reducing the costs of moving them when they are empty.

In its broadest first aspect the invention provides a platform adapted for the transport of goods, in which a) the platform is dimensioned to be received as a clearance fit inside a shipping container b) the platform is provided with means by which the platform may be moved in or out of the container c) the platform includes column members, lifting means or means to facilitate lifting being present on the column members, and the members are movable between one condition in which the columns are upright when a load of cargo may be present on the platform and a second condition in which the column members are horizontal whereby one platform may be stacked upon another.

In its broadest second aspect the invention provides a method of transporting goods using a platform, the platform having column members which in one condition are upright and in a second condition are horizontal, the members having lifting means by which the platform may be lifted, the platform being dimensioned to be received as a clearance fit inside a shipping container, which method comprises transporting a platform, as defined, by road and/or rail to a site, placing the platform on a road trailer or railway wagon; loading the platform, transporting the loaded platform by road or rail to the container and moving the platform on its wheels or rollers or like moving means into the container, including as appropriate transporting the container to a port of destination, removing the loaded platform and transporting to a place of use for the goods and there unloading the goods, moving the column members to the horizontal condition and then stacking the platform with other platforms and, moving the stack of platforms inside the shipping container for return to the first site.

It is a much preferred feature of the invention that the platform be provided with wheels or rollers as the moving means.

Filling the container at, say, the port is feasible because of the simplicity of the operation and the speed with which it may be accomplished which should lead to a reduction in port charges. Since moving the platform into a container by rolling or the like is so quick, it is feasible to fill the container in the ship, so avoiding one lifting charge. Although it is necessary to transport platforms to the site for loading, it is possible to carry a plurality of platforms on one lorry or truck. In cases where it takes a long time for the supplier to fill a container, the capital represented by the platform which is standing idle is reduced compared to that represented by a container or a container chassis one for each container standing idle, since the platform is less expensive to manufacture than a container or container chassis.

To facilitate loading a plurality of platforms on a lorry, the platform preferably includes recesses to receive the fork of a fork-lift truck of standard dimensions.

A column is preferably present at each corner of the platform. Preferably the lifting hooks are present at the top face of the columns. Preferably the columns are relatively tall so that the height of a platform when the columns are upright is in the proportion of about 15:1 compared to the height when the columns are horizontal.

The platform preferably includes means for immobilizing when within the container. In one alternative, the means for immobilizing the platform is a brake for each roller. In another alternative, the means for immobilizing the platform comprises means for lifting the rollers to an inoperative position. In yet another alternative, the means for immobilizing the platform comprises means for locking the platform in the container and, in this case, the means for locking the platform is preferably operable to lock the platform on a road trailer or railway wagon with standard international twist blocks when the platform is being removed from the container.

The invention also extends to a shipping container of standard dimensions in combination with a platform which is a clearance fit therein and which has means, preferably wheels or rollers enabling it to be moved into and out of the container when loaded.

The invention further extends to a shipping container of standard dimensions in combination with a plurality of platforms which together are a clearance fit therein. Preferably, each of the platforms is of dimensions which would, individually, provide a clearance fit in a shipping container of smaller standard dimensions.

A platform of the invention is preferably about 18 foot 6 inches (about 5.63 meters) long so that a single platform can be received in a 20 foot (about 6.09 meters) container or two such platforms can be received in line in a 40 foot (about 12.19 meters) long container. The width of the platform and the height of the column are selected so that there is a small clearance or gap between the platform and the facing inner wall of the container. The distance between the platform and the side walls may be about 2 inches (about 5.2 cm) and between the platform and the ceiling may be about 3 inches (about 7.5 cm).

Another important factor in determining transport costs is the maximum load allowable per truck for road transport: in the USA this is approximately 38 tons, including the vehicle weight. This means that if the total weight of vehicle and container and cargo will exceed the legal road weight, the shipper must either reduce the weight of cargo in the container or remove part of the load from the container at the port of arrival before it is put on the truck. Both options increase the cost. Because a platform of this invention weighs much less, typically 0.9 ton, more cargo can be carried without the risk of infringing the relevant road traffic regulations.

More specifically, in the USA, the maximum load allowable per truck inclusive of engine, trailer, fuel, cargo and chassis is approximately 38 tons. In the case of a 40 foot (about 12.19 meters) sea-going container the maximum allowable weight is approximately 26 tons plus its container weight of 5 ton giving total weight of 31 tons. The weight of the engine, chassis and trailer is approximately 13 tons, i.e.

| | | |
|---|---|---|
| | 26.0 | tons of cargo weight |
| | 5.0 | tons sea container weight |
| | 13.0 | tons truck engine trailer and chassis |
| Total | 44.0 | tons |

This combination will exceed the road allowable weight by 6.0 tons. As explained above, the only ways to sidestep the problem are either remove part of the cargo in the port (which will be expensive), or, to put less cargo in the port of origin. Which option is adopted depends on which cost is less, either part unloading in the arrival port and using ordinary lorries on arrival, or shipping less from the port of origin; usually the first option costs more because of additional port charges. Typically the shipper will reduce the weight down to 20 ton, to comply with the law. Because a platform of the invention weighs about 0.9 ton and can still carry much weight, the calculations are as follows

| | |
|---|---|
| cargo weight | 24.1 ton |
| platform weight | 0.9 ton |
| truck engine trailer and chassis | 13.0 ton |
| Total | 38.0 ton |

Therefore, an additional 4.1 ton cargo can be carried per container. In one specific example 100 sea containers loaded with cargo transported into a factory means, and 100 containers empty after discharge will have to be sent back to port. Using platforms of the invention in contrast, 100 rollout platforms with cargo transported into a factory means 5 truckloads after discharge will be sent back to sort each having a stack of 20 platforms. There will thus be a saving of 95 trucking costs.

Yet another advantage of the invention is that when the platform is loaded on a rail wagon, the cargo may be unloaded from any side whereas in a container unloading may be from the short end only.

Embodiments of the invention will now be described, by way of example, with reference to the accompanying diagrammatic drawings, in which:

FIGS. 5 and 7 are an exploded perspective view of one lifting column of the platform of FIG. 4 in the vertical condition and horizontal condition respectively;

FIG. 10 is a perspective view of part of a stack of platforms according to FIG. 9; and FIG. 11 is a perspective view of one column of the platform of FIG. 9 being prepared for horizontal stowing.

Figure 1:
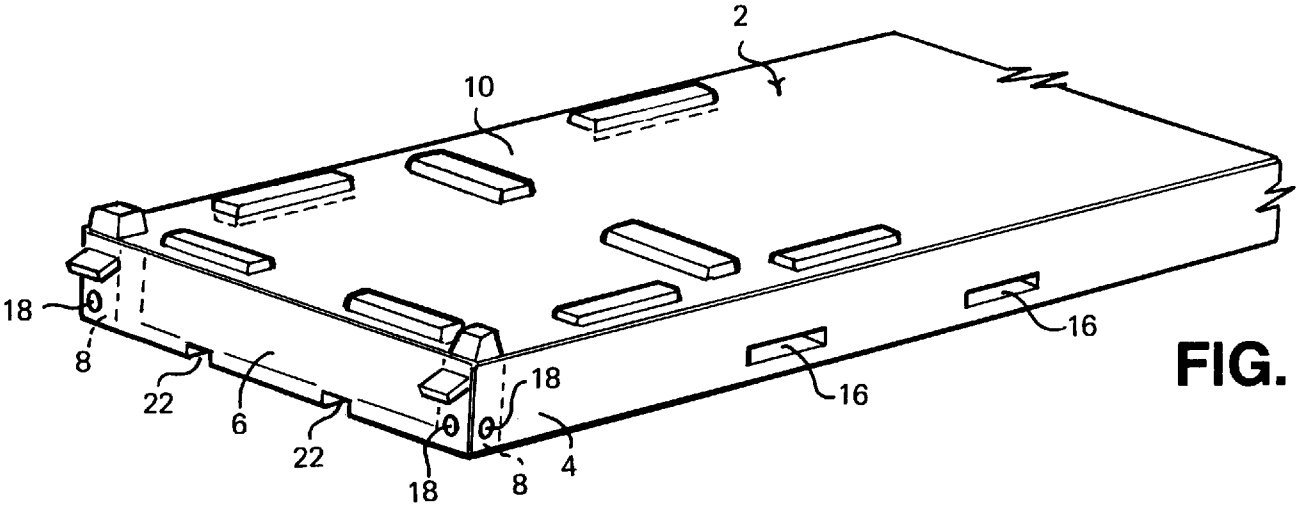
FIG. 1 is a perspective view from above of an end portion of one platform embodying the invention.
Figure 2:
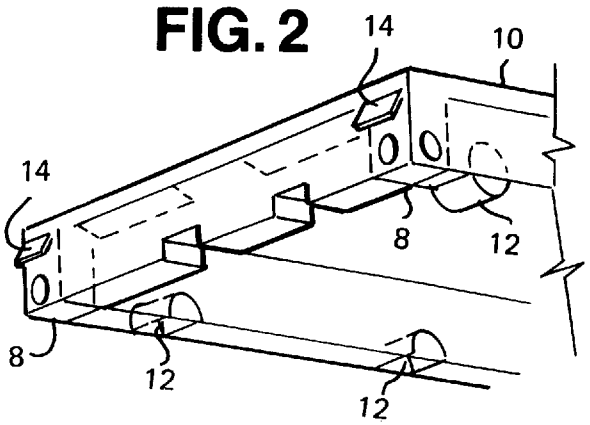
FIG. 2 is a perspective view from below of a portion of the platform of FIG. 1.

Referring to FIGS. 1 and 2, a steel platform 2 is constructed of peripheral-U-section frame members 4,6, interconnected by hollow corner posts or columns 8, and covered by a deck 10. The frame members 4 are hollow and rollers 12 are rotatably mounted therein. The rollers are mounted in a mechanism (not shown) controlled by levers 14 for extending respective rollers 12 beyond the frame members 4, as shown to the front of FIG. 2, or retracting the rollers inside the frame members 4, as shown to the rear of FIG. 2. The rollers may range from about 1.25 inch (about 3 cm) to about 2.5 inch (about 6 cm) in diameter. The dimensions of the deck provide a clearance fit in a shipping container (not shown) of standard dimensions, so that, with the rollers in the extended position, the platform may be rolled in and out of the open end of the container. Whereas the platform is, therefore, of a more or less standard width, e.g. 7 ft 7 ins approximately (about 2.31 meters), the length may be chosen to suit the internal dimensions of the different lengths of container which are variously available. For example the platform may have a length to suit a 20 or a 40 ft container, e.g. 18 ft 6 inches (about 5.63 meters) or 19 ft 3 ins approximately (about 5.86 meters) or 39 ft 5 ins approximately (about 13.32 meters). The platform will typically measure about 7 ft 3.75 ins (about 2.25 meters) wide and about 7 ft 10 inches (about 2.41 meters) high.

The side frame members 4 have recesses or tunnels 16 therein to receive the forks of a fork lift truck of standard dimensions. One or a stack of the platforms may be loaded onto a road trailer or railway wagon for transport to a remote site for loading or returning to port. The end posts or columns 8 are provided with holes 18 in which lifting hooks may be attached. The collapsible columns are not shown in FIGS. 1 and 2, but in FIGS. 3 to 11.

Each end frame member 6 (only one is shown in FIG. 1) is provided with slots 22 to receive hooks for lifting where a standard twist block crane is not available e.g. in a remote port or jetty.

Because of its structure, the platform is light in weight, say 0.9 tons. In use, the platform is loaded onto a road trailer or railway wagon in a stack and transported to a site where it is to be filled. The stack of platforms is off-loaded from the trailer or wagon and the platforms are loaded individually with the goods it is desired to transport. The loaded platforms are transported to, say, a port, by road trailer and/or railway wagon. At the port the platform is off-loaded from the lorry either by sliding it off or by lifting, to place it on the ground. It is then rolled into an empty container, which it may fill with clearance, or two or more short platforms may be rolled into one long container. Once inside the container the levers 14 are operated to retract the rollers inside the Frame members 4 so immobilizing the platform.

In order to secure the load, the deck is provided with loops or hooks (not shown) through which ropes or straps may be passed.

Figures 3, 8:
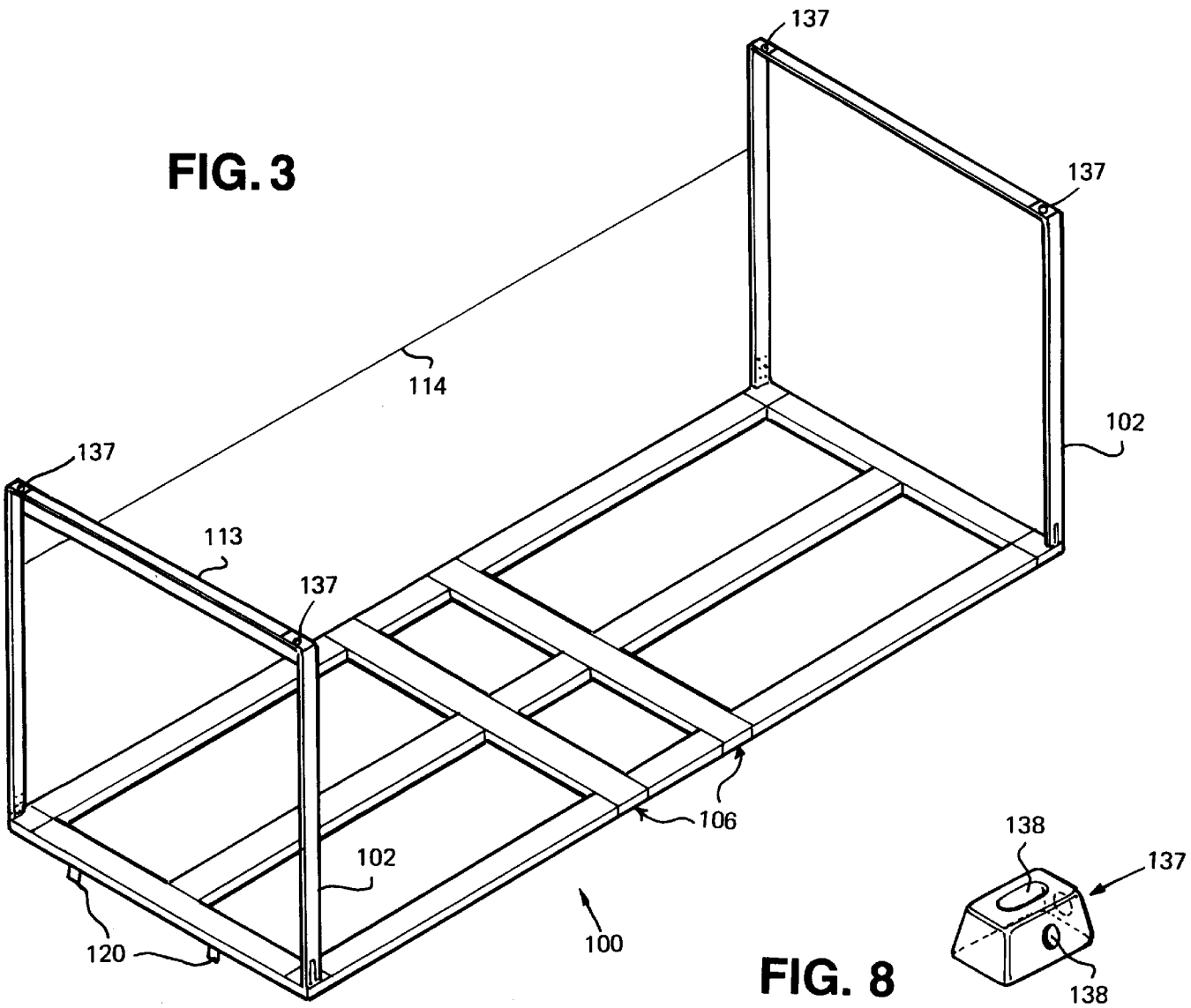
FIG. 3 is a perspective view from above of platform including lifting columns at the shorter ends thereof.
FIG. 8 shows the block drawing to an enlarged scale at the top of the lifting columns shown in FIG. 3.
Figure 4:
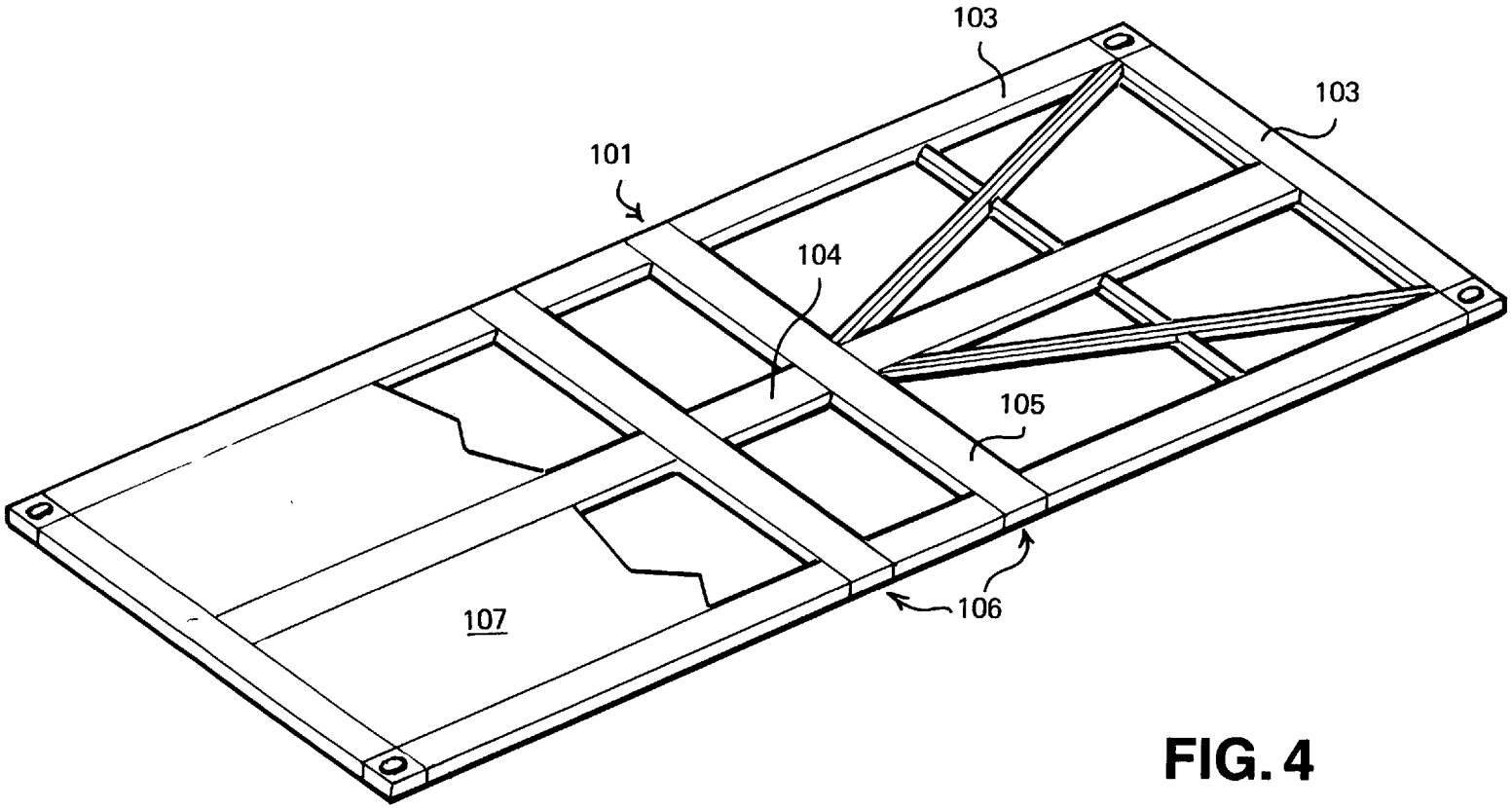
FIG. 4 is a perspective view, partly in section, of the platform of FIG. 3.

The platform 100 of FIGS. 3 to 8 comprises a rectangular base 101 having lifting columns 102 at each of the shorter ends. As best shown in FIG. 4, the base comprises side walls 103 of rectangular tubular shape, having a longitudinal beam 104 and cross struts 105, the latter having edge recesses or sockets 106 to receive the blades or tines of a fork lift, not shown. The platform has a deck or floor 107 of wood or metal.

Figure 5:
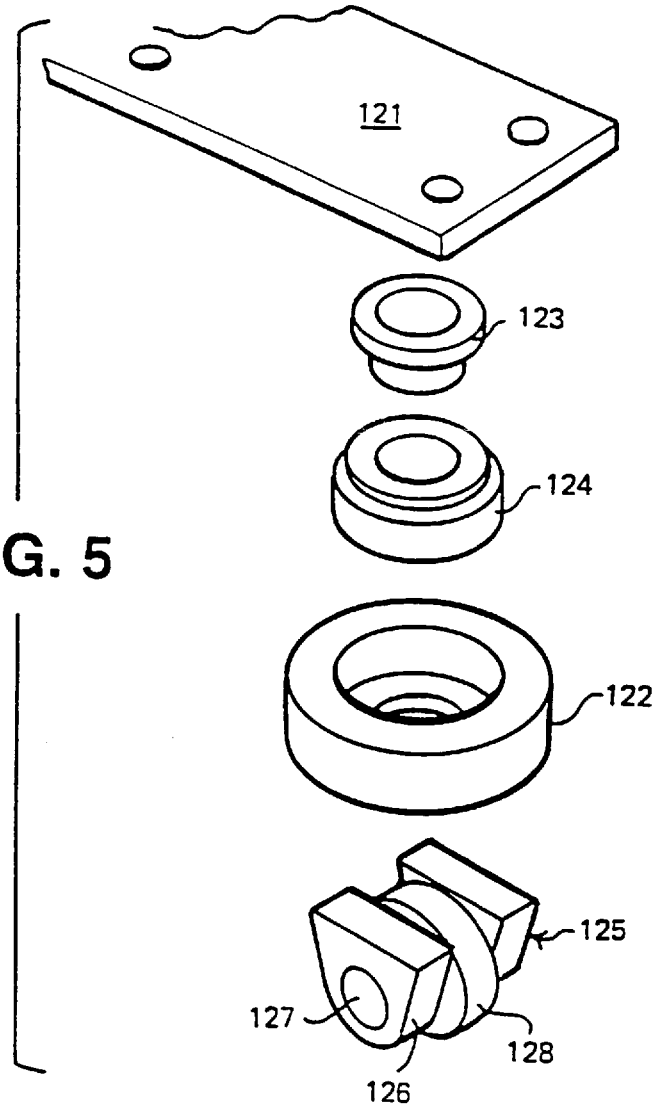
FIG. 5 is an exploded perspective view of a roller assembly of the platform of FIG. 3.

Rollers 120 are mounted on the underside of the base; there are eight such rollers for a platform of the dimensions shown in FIG. 3. As best shown in FIG. 5, a mounting plate 121 is present below the base 100 at each selected location, and a roller assembly is secured thereto. Each assembly comprises a housing 122 containing an upper swivel 123 within a roller bearing 124, below is the roller shaft assembly 125 comprising two side arms 126 bridged by the shaft or axle 127 on which the roller wheel 128 is mounted.

Figure 6:
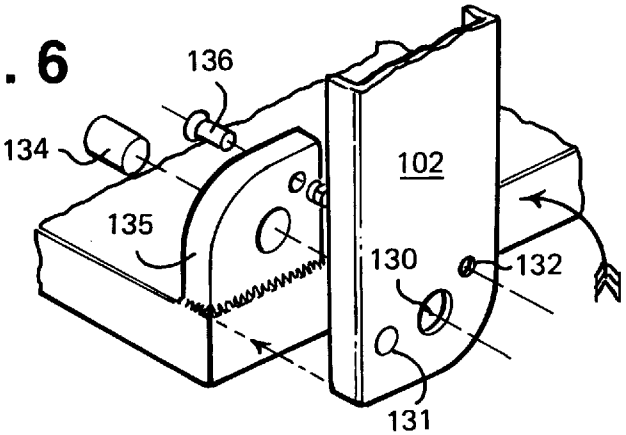
Figure 7:
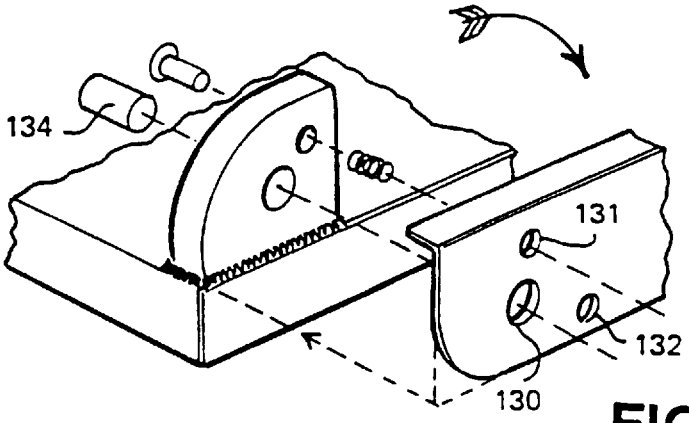

As best shown in FIGS. 6 and 7, each column 102 is of angle section and has three holes 130, 131, 132 at the foot thereof.

The central hole 130 houses a permanent hinge pin 134 which extends into an upstanding block 135 at each corner of the base 101. A spring loaded pin 136 is present in the block to be received in either of the smaller holes 131, 132, dependent on whether the column is vertical (FIG. 6) or stowed horizontal (FIG. 7). The top of the columns have apertured corner fittings or twist blocks 137 which have slots 138 to enable connections to be made from different sides. The columns 102 at each end of the base 101 are joined by a cross member 113 and the columns at the ends may be joined by a line stopper 114. The assembly may be covered, e.g. by a tarpaulin when the cargo of goods is loaded on.

In embodiments (not illustrated) the platform may be locked on the road trailer or railway wagon by conventional twist locks. Additionally or alternatively the platform may be locked in position in the container by the twist locks. In another alternative, means are provided for braking the rollers to immobilize the platform. In yet another alternative, the rollers are replaced by wheels.

Figure 9:
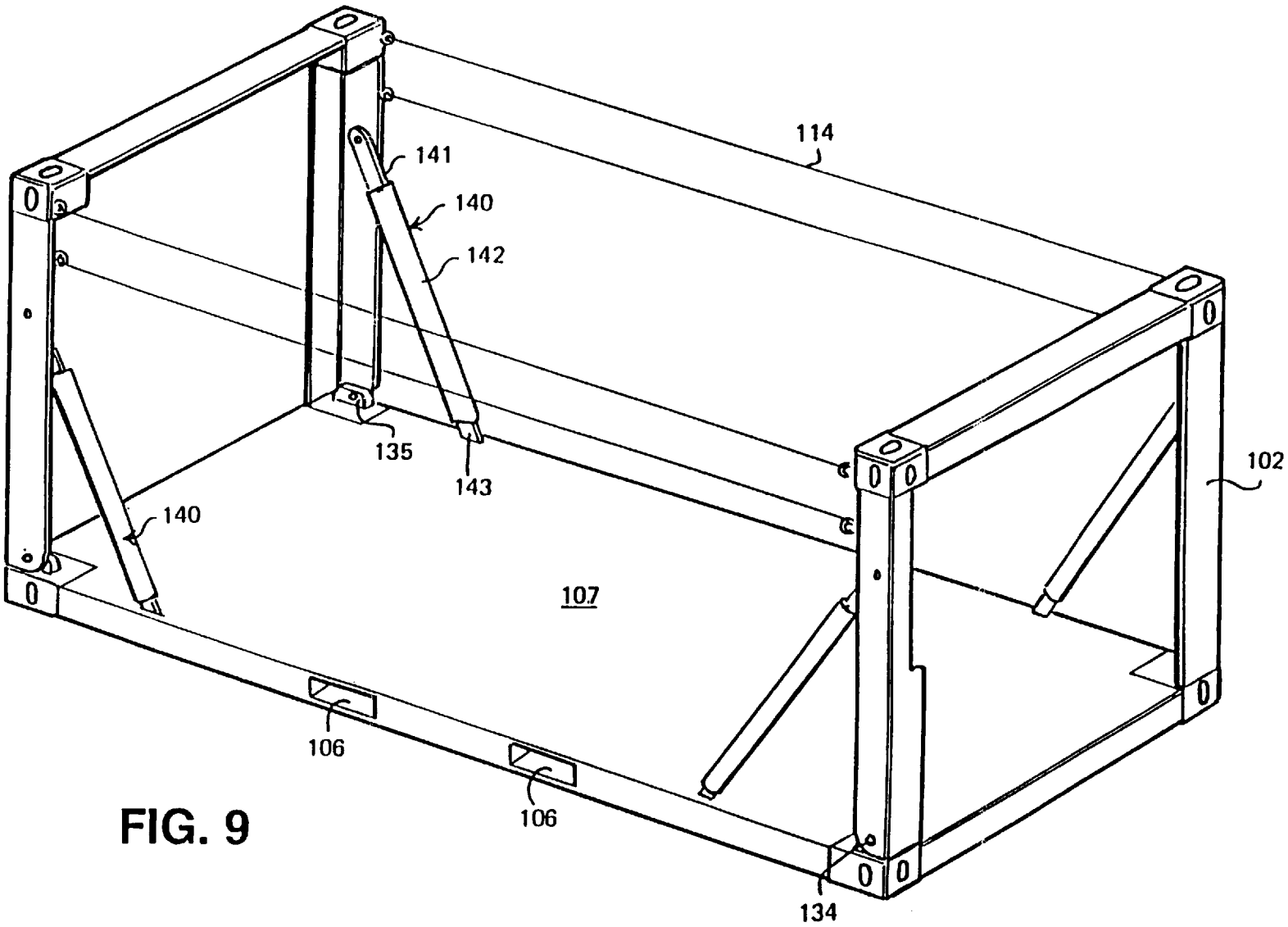
FIG. 9 is a perspective view of another embodiment of the invention with the columns in the upright condition.

In the embodiment of FIGS. 9 to 11, for which the same reference numerals as those used in relation to FIGS. 3 to 8 will be used where possible, the columns 102 are provided with telescopic reinforcing struts 140. One end of arm 141 of a strut 140 is pivotally mounted towards the top of each column below the level of the line stopper 114, the arm being receivable in a cylindrical housing 142. The foot of the columns is hingedly mounted on the platform to block 135, so that when each column is raised (see FIG. 10 for the stowed condition) the respective strut is extended and an arm 143 at the lower end of the housing 142 is extended to engage the platform base 101, so holding the column upright. A slot, not shown, may be provided in the base to receive the arm 143. When the columns are stowed, a stack of platforms 100 may be made, as shown in FIG. 10.

The invention is not limited to the embodiments illustrated. The platform may also be a pallet. The moving means may be wheels or rollers as shown or a slide system capable of moving a platform laden with cargo. The columns may be provided with alternative raising and lowering means. The platform base may be preformed in one piece and lightweight materials, metallic or non-metallic, may be used.

I claim:

1. A lightweight platform adapted to carry cargo, the platform comprising a rectangular base member having wheels or rollers, the rectangular base member comprising opposing ends and two sides connecting said ends and being dimensioned for a clearance fit inside a standard shipping container, recesses in at least one side of the base member for reception of the forks of a fork lift truck, columns at the four corners of the rectangular base member, each said column having means to facilitate lifting at the top thereof, the columns being movable between a first condition in which they are upright and the platform may be lifted by lifting devices attached to the means to facilitate lifting on the four columns, and a second condition in which the columns are horizontal and extend along edges of the base member whereby one such platform may be stacked on another and wherein each column is of angle section, a cross beam connecting the top of each pair of said columns at each said end of the base member, a line stopper extending between each pair of said columns along the sides of the base member and wherein each said means to facilitate lifting comprises an apertured corner fitting.

* * * * *